United States Patent [19]

Matsumura

[11] 4,217,752

[45] Aug. 19, 1980

[54] FIXING STRUCTURE OF BACK COVER FOR WATCH

[75] Inventor: Osamu Matsumura, Chofu, Japan

[73] Assignee: Citizen Watch Co., Ltd., Tokyo, Japan

[21] Appl. No.: 880,588

[22] Filed: Feb. 23, 1978

[30] Foreign Application Priority Data

Feb. 25, 1977 [JP] Japan ..... 52-21994[U]

[51] Int. Cl.[2] ..... G04B 37/08; G04B 37/00

[52] U.S. Cl. ..... 368/289; 368/287

[58] Field of Search ..... 58/23 BA, 53 SS, 57, 58/59, 88 R, 88 C, 90 R, 94

[56] References Cited

U.S. PATENT DOCUMENTS

| | | | |
|---|---|---|---|
| 2,858,663 | 11/1958 | Schwartz | 58/90 R |
| 2,862,352 | 12/1958 | Burghoff | 58/90 R |
| 3,156,086 | 11/1964 | Egger | 58/88 R |
| 3,777,473 | 12/1973 | Bussi | 58/90 R |
| 3,838,568 | 10/1974 | Zurcher et al. | 58/88 C |

FOREIGN PATENT DOCUMENTS

| | | | |
|---|---|---|---|
| 1386681 | 2/1964 | France | 38/90 R |
| 343942 | 2/1960 | Switzerland | 58/90 R |
| 1042457 | 9/1966 | United Kingdom | 58/90 R |

*Primary Examiner*—Vit W. Miska

*Attorney, Agent, or Firm*—Sherman & Shalloway

[57] ABSTRACT

A fixing structure of a back cover for watches without requirement of any jig to attach a back cover to a watch casing. The fixing structure is disclosed which comprises a watch movement, an outer casing for accomodating said watch movement therein and provided with an opening at the lower portion thereof, a back cover engaged with said outer casing, a first flange formed at the side of said movement on said opening and being shorter than the outer diameter of said back cover, a second flange formed at the opposite side of the movement on the opening and being longer than the outer diameter of said back cover, and the diameter of the opening in said second flange being shorter than the outer diameter of said back cover, a peripheral groove formed between both said first and second flanges, and a flexible packing attached to said peripheral groove, whereby said back cover is attached to the inside of said flexible packing from the direction of said first flange.

2 Claims, 10 Drawing Figures

FIXING STRUCTURE OF BACK COVER FOR WATCH

This invention relates to a fixing structure of a back cover for watches.

Heretofore there has been proposed a back cover structure for a watch as shown in FIG. 1 in which a flexible packing 4 is attached to an attaching portion of a back cover 4, so that the back cover 1 is screwed to a watch casing 3 and thereby the flexible packing 4 being compressed in the axial direction to attain a waterproof structure. However this structure requires it to strongly compress the flexible packing 4 in order to keep the waterproof characteristics. Thus a large rotation torque should be given to the back cover 1, so that it is necessary to rotate the back cover 1 by means of an exclusive jig with a special pawl.

Further there has been proposed another conventional structure as shown in FIG. 2 in which a groove 11 is formed at the lower surface. Therefore in order to screw the back cover 1 to a watch casing 3, a coin is inserted into the groove 11 and a rotation torque is given thereto. However this structure requires that the depth of the groove is (t) as shown. As the result, the thickness (T) of the back cover becomes thick so that the total thickness of the watch becomes thick and as the result, this becomes a bar to thin the thickness thereof.

An object of this invention is to provide a fixing structure of a back cover for a watch in which the above defects of the conventional structure are obviated and there are provided advantages that no exclusive jig is required, that the thickness of the back cover can be made thin, and that it is precisely and easily effected to put on and off the back cover of the watch.

Hereinafter there will be described embodiments of this invention with reference to the accompanying drawing wherein.

Figure 3:
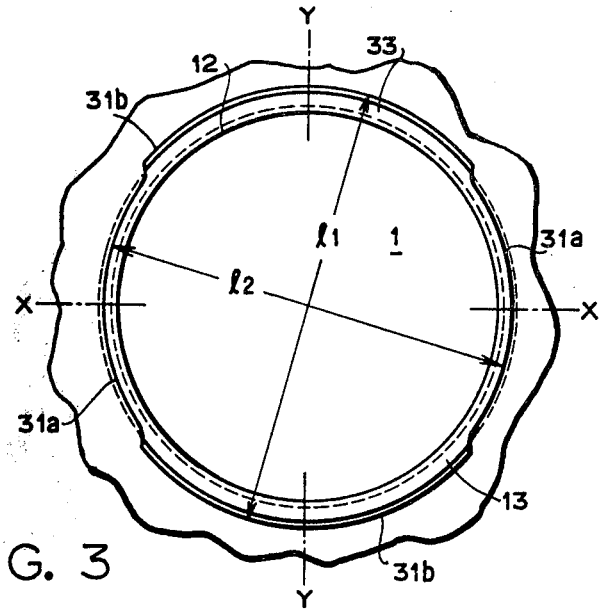
FIG. 3 is a plan view of a fixing structure of a back cover for a watch showing one embodiment of this invention.
Figure 4:
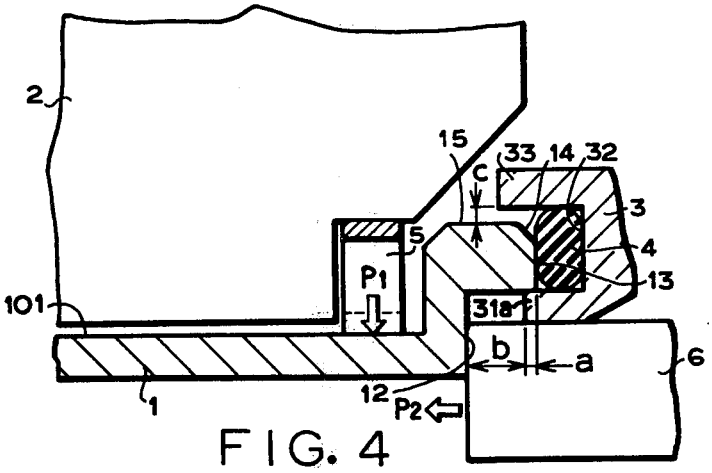
FIG. 4 is a sectional view along line X—X of FIG. 3.
Figure 5:
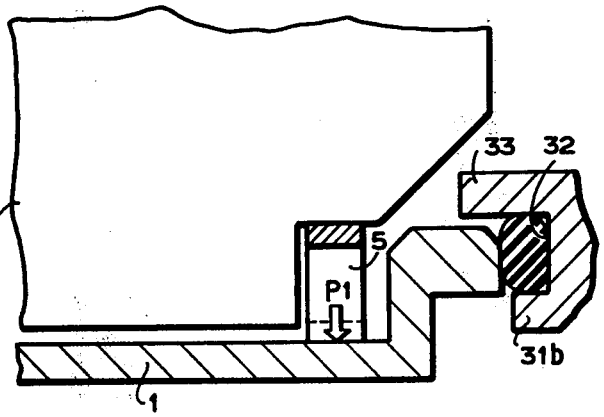
FIG. 5 is a sectional view along line Y—Y of FIG. 3.

In FIGS. 3 to 5, an opening is formed at the lower portion of an outer casing, for example, a watch casing 3 to accomodate a movement 2. At the side of the movement 2 on the opening, there is provided a flange 33 which is circular and is shorter in its diameter than the outer diameter of a back cover 1. While at the outside, non-circular flanges 31*a*, 31*b* are provided whose diameter l1 between opposite inner edges of the opening is longer than the outer diameter of the back cover 1 and whose diameter l2 from the other opposite inner edges is shorter than that of back cover 1. A peripheral groove 32 is formed between the flanges 31*a*, 31*b* and the flange 33. A flexible packing 4 is attached to the peripheral groove 32.

The back cover 1 is inserted into the opening obliquely from the direction of non-circular flanges 31*a*, 31*b* and is attached to the opening with compressing the flexible packing 4 in the diametrical direction. At the rear face of the back cover 1, there is provided a flexible member 5 biased outwardly and a rise-up portion 12 is formed at the outside of the back cover 1, which has a circular periphery 13.

Nextly there will be described a method of attaching the back cover 1 to the watch casing 3. At first the flexible member 5 is positioned on the movement 2 and the flexible packing 4 is arranged on the peripheral groove 32. A portion of the periphery 13 of the back cover 1 is inserted into the peripheral groove 32 obliquely by slightly hooking one of the flange 31*a* whose diameter is shorter than the outer diameter of the back cover 1. Furthermore the periphery 13 is continuously inserted into the depth of the peripheral groove 32. When a slant 14 formed on the opposite periphery 13 reaches on flange 31*a* the back cover 1 is strongly pressed toward the movement 2. Then the reaction force of the opposite periphery 13 is delivered to the opposed flange 31*a* so as to be inserted into the peripheral groove 32 in good timing, and thereby the whole of the periphery 13 being attached to the peripheral groove 32. While the flange 31*b* does not make contact with the periphery 13. Since the flexible packing 4 is evenly compressed under the attaching state, the watch keeps stable waterproof and the engaging length (a) of the back cover 1 and flange 31*a* is equal in the right length and the left length so that the back cover 1 does not disengage the flange 31*a* by accident. The attaching operation may be manually effected in ease and thereby any jig being not required. Of course, it is required to give a counterpressure against the force $P_1$ of the flexible member 5 when the back cover 1 is attached to the watch casing.

Nextly there will be described a disassembling work. As shown in FIG. 4, the rise-up portion 12 of the back cover 1 is depressed along line X—X by the force $P_2$ by means of a member with an edge less than 90°, for example, a coin so that the opposite flexible packing 4 is deformed and thereby the periphery 13 of the back cover 1 being biased more inwardly than the non-circular flange 31*a* and as the result, the back cover 1 is depressed to be disengaged by the force $P_1$ of the flexible member 5 biased to the rear face of the back cover 1. Therefore the back cover 1 is easily disengaged by the force $P_1$ of the flexible member 5 biased outwardly. In design, a gap (c) between the upmost surface 15 of the back cover 1 and the flange 33 is essentially required, because the back cover 1 should be inserted in an oblique direction. Since the back cover 1 is always shifted to one corner of the casing 1 when the back cover 1 is disassembled, a gap (b) between the rise-up portion of the back cover 1 and the flange 31*a* should be longer than the engaging length (a) between the back cover 1 and the flange 31*a*.

FIGS. 6 to 10 shows other modified embodiments of this invention and correspond to a section along line X—X of FIG. 3.

Figure 1:
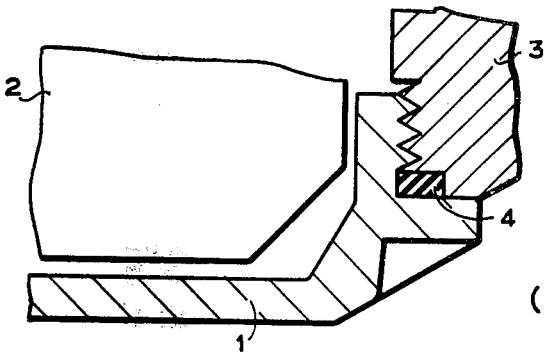
FIG. 1 (PRIOR ART)
FIGS. 1 and 2 are partially amplified sections of the conventional fixing structure of a back cover for a watch.
Figure 2:
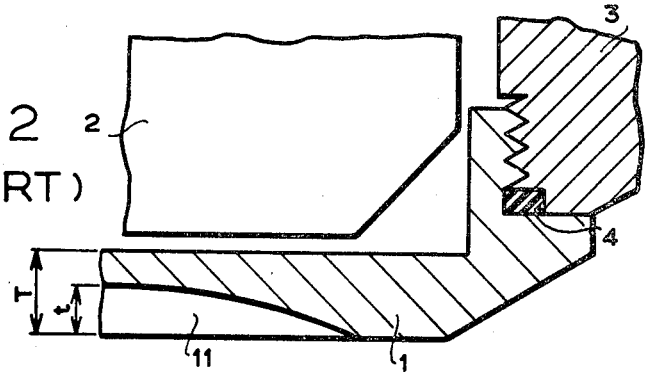
FIG. 2 (PRIOR ART)
Figure 6:
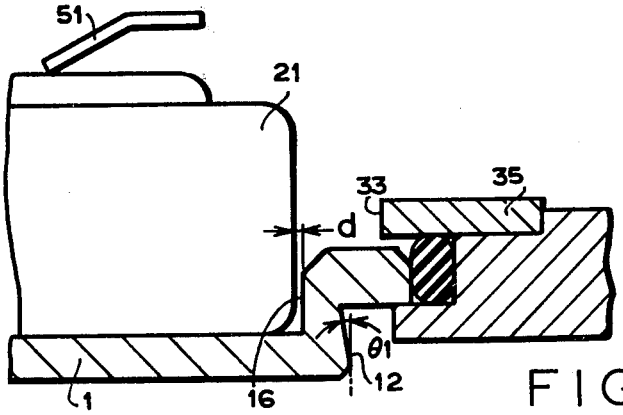
FIGS. 6 to 10 are sectional views along line Y—Y of FIG. 3 according to other modified embodiments of this invention.

In FIG. 6 a battery cell supporting spring 51 functions as a flexible member 5. The circular flange 33 is formed separately in order to be easily manufactured. A ring member 35 with the flange 33 is fixed to the casing 3 by mechanical coupling means, e.g. waxing, adhering, caulking. In this embodiment, the rise-up portion 12 of the back cover 1 is angled by $\theta_1$ as shown in FIG. 1 to be easily disengaged. A gap (d) between a battery cell 21 of a part of the movement 2 and the rise-up portion 16 at the inner periphery of the back cover 1 is made small to determine the position of the battery cell 21.

Figure 7:
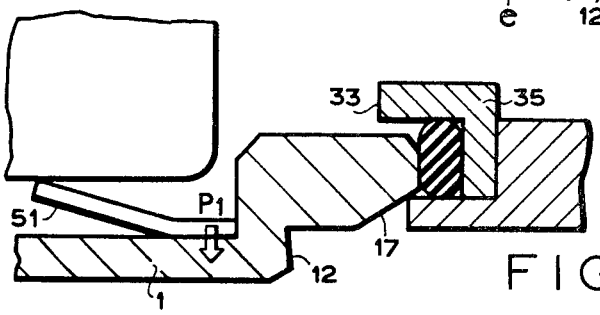

In FIG. 7 the battery cell supporting spring 51 attached to the back cover 1 is also functions like the flexible member 5 of FIG. 6 and the ring member 35 integrating the circular flange 33 with peripheral groove 32 is fixed to the casing 3 by the same coupling method. In this case, the coupling method requires waterproof characteristics. In design, it is considered that a slant 17 is formed at the lower periphery of the back cover 1 to fix the back cover 1 at the centre by utilizing component force in the diametrical direction of the force $P_1$ of the battery cell supporting spring 51.

Figure 8:
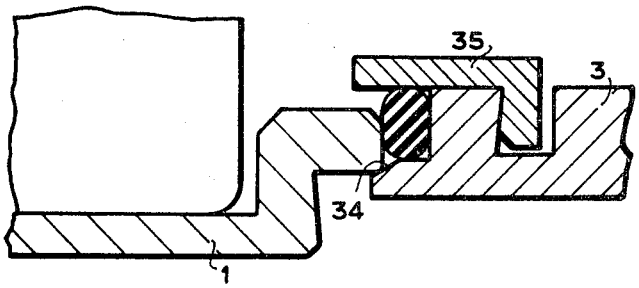

In FIG. 8, a slant is formed at the inner periphery of the casing 3 to obtain the same effect in FIG. 7. It is possible to combine the slant 17 (FIG. 7) of the back cover 1 with the slant 34 of the casing 3. The ring member 35 is fixed to the casing 3 with engagement structure.

Figure 9:
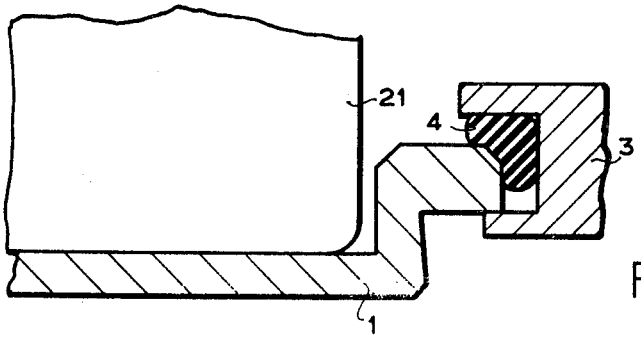

In FIG. 9 the flexible packing 4 is obliquely compressed by the back cover 1 and casing 3, in which the same effect is acknowledged.

Figure 10:
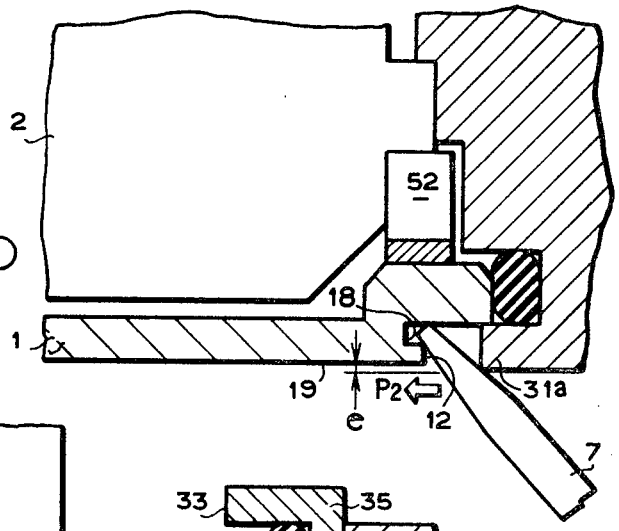

In FIG. 10, an intermediate frame 52 functions as the flexible member 5. The lowermost surface 19 of the back cover 1 is arranged above the flanges 31*a*, 31*b* (difference in level $l>0$) and a disengaging groove 18 is formed at a portion of the rise-up portion 12 of the back cover 1 to be disassembled by a driver 7 etc. and thereby the back cover 1 being easily disassembled by the coin 6. According to this embodiment the back cover 1 is not subjected to a lateral force when the watch is ordinarily worn and thereby the safty of attaching being increased and as the result, the effect is large.

Since the fixing structure of a back cover for a watch according to this invention is constructed as set forth above, it is easy in working, stable in waterproof, not required any special jig to put on and off a back cover, extremely simple in assembling and disassembling, thinned its thickness of the back cover and finally thinned the total thickness of the watch. Therefore this invention is extremely effective in practice.

What is claimed is:

1. A fixing structure of a back cover of a watch comprising:

(a) an outer casing for accommodating a watch movement therein and provided with an opening at the bottom thereof;

(b) a back cover having a generally planar central portion and an annular flange portion surrounding said central portion and situated in a plane axially offset with respect to said central portion in a direction towards the top of said outer casing, the axial offset between said central portion and said flange portion defining a continuous surface on the exterior of the back cover which forms an angle with the plane of said central portion which is less than or equal to 90°;

(c) a first flange formed on said outer casing at an inner side of said opening with respect to the casing interior, said first flange having a diameter smaller than the diameter of the outer periphery of the flange portion of said back cover;

(d) a second, arcuate flange and a third, arcuate flange co-planar with each other and formed on said outer casing at an outer side of said opening with respect to the casing interior, said second flange having a circular shape with a diameter greater than the diameter of the outer periphery of the annular flange portion of said back cover and said third flange having a circular shape with a diameter smaller than the diameter of the outer periphery of the annular flange portion of said back cover;

(e) a peripheral groove formed between said first flange and said second and third flanges; and (f) a resilient packing located in said peripheral groove, the inside diameter of said resilient packing in a noncompressed state having an inside diameter which is less than the outside diameter of the annular flange of the back cover and is greater than the inside diameter of the first flange; such that the back cover is attached to the outer casing by the engagement of the annular flange portion of the back cover between said first flange and said second and third flanges; and such that when the back cover is so attached the resilient packing is compressed by the outer periphery of the annular flange portion of the back cover in a direction having at least a component in a plane parallel to the plane of the central portion of the back cover and a component perpendicular to the plane of the central portion of the back cover, and that the back cover is removable from the outer casing by exerting a force on said continuous surface of the back cover in a direction having at least a component in a plane parallel to the plane of the central portion of the back cover.

2. A fixing structure according to claim 1 wherein said resilient packing in the compressed state has an inside diameter which is less than the inside diameter of the second flange and greater than the inside diameter of the first flange.

* * * * *